United States Patent [19]

Britch et al.

[11] 3,958,633

[45] May 25, 1976

[54] FLAPPER-TYPE SUBSURFACE SAFETY VALVE

[75] Inventors: James A. Britch, Lafayette; John R. Smith, New Orleans, both of La.

[73] Assignee: Standard Oil Company (Indiana), Chicago, Ill.

[22] Filed: May 29, 1975

[21] Appl. No.: 581,602

[52] U.S. Cl. ..... 166/117.5; 166/224 A; 251/228; 251/243

[51] Int. Cl.[2] ..... E21B 7/06; E21B 43/12

[58] Field of Search ..... 166/117.5, 117.6, 224 R, 166/224 A; 137/495, 498; 251/58, 62, 228, 298, 303, 231, 243

[56] References Cited

UNITED STATES PATENTS

| | | | |
|---|---|---|---|
| 2,780,290 | 2/1957 | Natho | 166/224 |
| 2,786,535 | 3/1957 | Boer et al. | 166/224 |
| 2,798,561 | 7/1957 | True | 166/224 |
| 3,375,846 | 4/1968 | Canalizo | 137/155 |
| 3,665,955 | 5/1972 | Conner | 166/117.5 |

*Primary Examiner*—James A. Leppink
*Attorney, Agent, or Firm*—John D. Gassett; Arthur McIlroy

[57] ABSTRACT

This is a subsurface safety valve for insertion in a tubing string in a well drilled in the earth, normally for the production of oil and gas. This valve is lowered and retrieved by wireline and is seated in a special side-pocket mandrel which is a part of the tubing string. One suitable valve is a flapper-type, full-opening valve having a folding or collapsing flapper that permits it to retract completely into the side pocket, thereby leaving a full opening through the valve and tubing string when open. The valve may be controlled either by hydraulic pressure transmitted to it from the surface or by subsurface pressure sensing means.

4 Claims, 4 Drawing Figures

FLAPPER-TYPE SUBSURFACE SAFETY VALVE

BACKGROUND OF THE INVENTION

1. Field of the Invention

This invention relates to a safety valve for use in the production of oil and gas. It especially relates to a safety valve set in a tubing string of a well drilled in an offshore or water-covered area. In such situations a safety valve is usually set in a tubing string below the mudline. Then, if the tubing string is broken by any means such as a ship or a barge which may be adrift in a storm, the subsea safety valve will shut off the flow of fluids to the tubing string and prevent a "runaway" well which would otherwise occur.

2. Prior Art

There are many subsurface safety valves which are commercially available, and even many others that have been described in the patents and literature. Some of these valves are operated or controlled from the surface, normally by a long, slender tube which supplies fluid under pressure to hold the valve in an open position. If the control fluid supply should be disrupted, such as by the control line breaking, the valve automatically closes. Another type downhole safety valve is that group which are selfcontained; they usually depend upon a pressure drop to the valve as an actuating medium or force. If the pressure drop through the valve becomes excessive, the valve is forced to a closed position.

In regard to prior art, there are many tools which are run and set in sidewall pockets. Perhaps the most common of these are the gaslift valves such as shown in U.S. Pat. No. 3,375,846, for example. None of these sidewall tools of which we have knowledge are used or can be used as safety valves.

SUMMARY OF THE INVENTION

This is a downhole safety valve for use in a tubing string having a side pocket and suspended in a wellbore which has been cased with steel casing. A flapper-type safety valve is pivotally attached to an operator which is installed using a kickover tool. The operator also is provided with a drive arm which pushes the flapper valve about a pivot when operated. The kickover tool, the operator, and the flapper valve and its associated equipment are lowered through the tubing string, and the kickover tool causes the flapper valve and the operator to be lowered into the sidewall pocket. The sidewall pocket has an opening at the lower end into the flow path of the main tubing string. When the valve assembly is seated in the sidewall pocket, the actuating port means is positioned to receive hydraulic control fluid from a hydraulic control line from the surface. Hydraulic pressure keeps the valve open and loss of control hydraulic pressure causes the valve to close.

BRIEF DESCRIPTION OF THE DRAWING

Various objectives and a better understanding can be had of the invention by the following description taken in conjunction with the drawings, in which.

Figure 1:
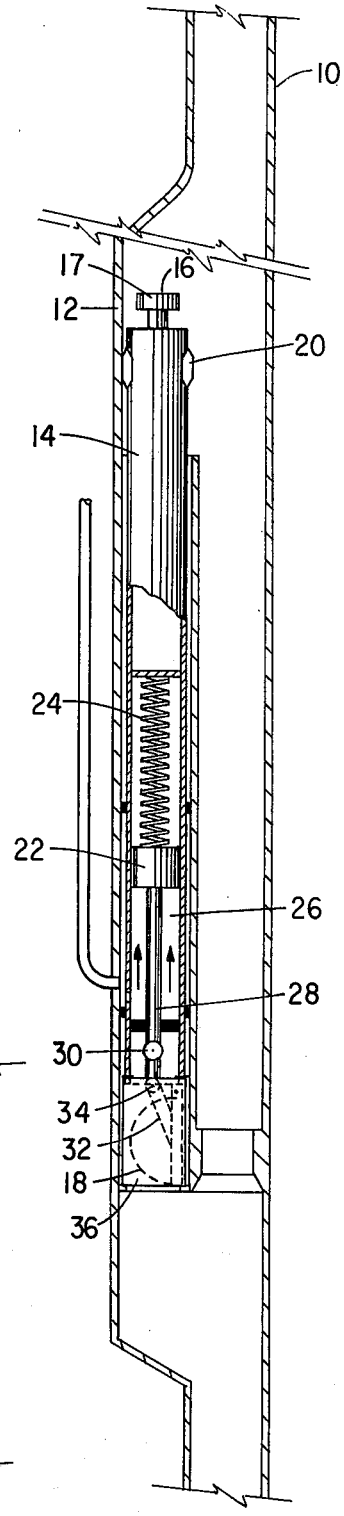
FIG. 1 illustrates the safety valve partly in section and partly whole face in a side pocket in a downhole string of tubing with the flapper valve in a protective sleeve.

Attention is next directed to the drawing and, in particular, FIG. 1. Shown therein is indicated tubing string 10 having a side pocket 12. The section of tubing string equipped with the side pocket is inserted in a tubing string as the string is run in an ordinary manner. Side pockets are quite common. Shown partially inserted in the side pocket 12 is a tool having a valve 18 at the lower end connected to a body 14 of the tool with an oriented running neck 16 at the upper end. Running neck 16 is attachable to a running tool in an oriented position. This can be accomplished by providing a flat shoulder 17 on neck 16 and a complementing receiving latch on the running tool itself. Near the upper end of the body 14 are locking means 20. The locking means 20 is well known in sidewall tools. Thus, no detailed explanation is believed necessary. Body 14 can be oriented as necessary. The lower end of the tool is equipped with a valve 18 which is actuated by an operator. The operator includes body 14 and piston 22 urged downwardly by spring 24. The piston 22 is urged upwardly by fluid in chamber 26. Piston 22 is connected through piston arm 28 having intermediate pivot 30 and the lower end of piston arm 28 is connected to a lower arm 32 by a pivot 34. These pivots permit proper relative motion so that movement of piston 22 opens or closes valve 18.

When in the position in FIG. 1, which is the "running" position, valve 18 is held in an open position by sleeve 36. This is shown more clearly in FIG. 2. Shown therein is sleeve 36 which is held onto body 14 by an upper internal shoulder 38. Upward movement of shoulder 38 with respect to sleeve 14 is prevented by shear pin 40. The function of sleeve 36 is to prevent valve 18 from "flapping" to its outward position during the lowering of the valve, which would be the case without the sleeve. Sleeve 36 is needed due to the fact that spring 24 urges piston 22 down and during the running of the tool there is no fluid pressure urging the piston 22 upwardly. Thus, piston 22 is urged toward its downwardmost position. However, during the running of the tool, sleeve 36 holds the valve in its position as shown in FIGS. 1 and 2.

Figure 3:
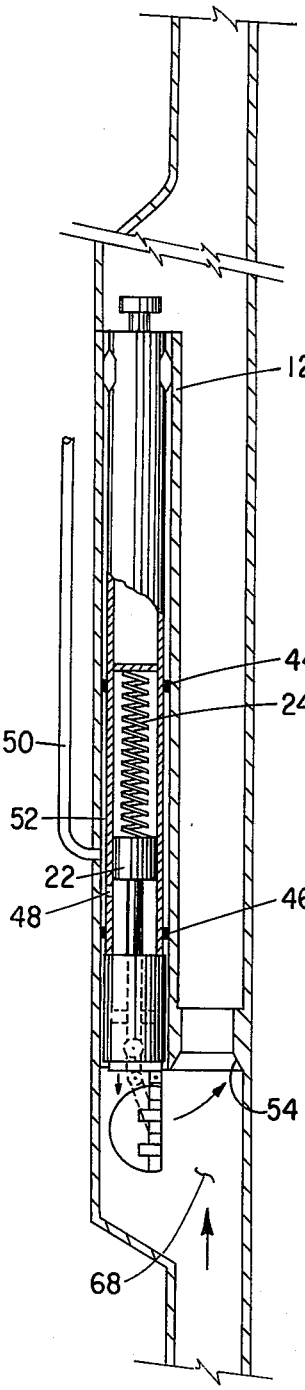
FIG. 3 is similar to FIG. 1 except that the valve has been forced out of the protective sleeve and is in the operative position.
Figure 2:
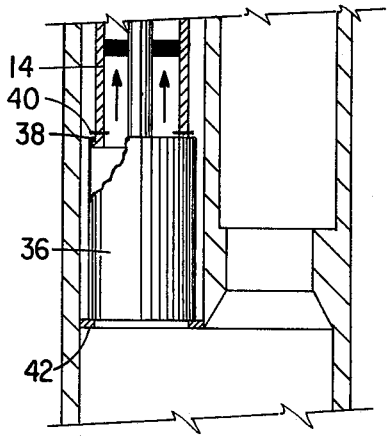
FIG. 2 is an enlarged portion of FIG. 1 showing the protective sleeve and its attachment to the main body of the valve.

When the tool has been run to the position shown in FIG. 2, and it is desired to go ahead and set the device properly, additional force is applied with the running tool through the running neck 16 to shear pin 40. This permits the body 14 to move downwardly through sleeve 36 into the position shown in FIG. 3. When in the position in FIG. 3, the tool is in an operative position. The body has upper seal 44 and a lower seal 46 between the body 14 of the tool and the inner wall of the pocket 12. There is a port 48 in the wall of the tool and positioned vertically between the seals and below piston 22. A hydraulic control line 50 extending from the surface enters through the sidewall pocket and into the annular space 52 between the body 14 of the sidewall pocket 12 between seals 44 and 46. The fluid pressure thus entering in this annular space is also injected through port 48 so that fluid pressure applied through line 50 drives piston 22 upwardly, thus compressing spring 24. In FIGS. 1 and 2, the sleeve 36 kept the valve 18 from "swinging out" to its closed position. In FIG. 3, it is the upward force on piston 22 by fluid from control line 50 which prevents the valve from seating against seat 54.

Figure 4:
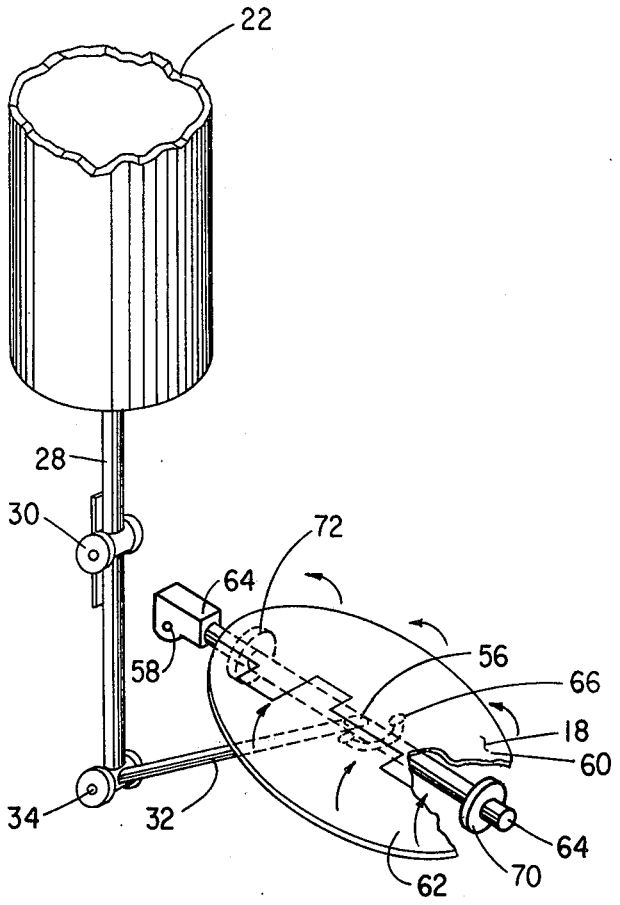
FIG. 4 illustrates the collapsible flapper valve and its attachment to the piston of the valve.

Attention is next directed to FIG. 4 which illustrates in a little greater detail the operation of flapper valve 18. Various type collapsible flapper valves can be used. However, we have shown one that appears to be particularly desirable. In FIG. 4, the extension arm 32 from piston rod 28 is typically connected at 56 to valve 18. Valve 18 is shown in two halves, 60 and 62, which are hinged at axle or hinge 64. The valve, sections 60 and 62, are urged into their collapsed position by spring 66. Stops 70 and 72 hold the sections 60 and 62 on the hinge 64. Hinge 64 is connected to body 14 by pivot 58. When the valve is in its position shown in FIGS. 1, 2, and 3, it is in its collapsed position and is held that way by spring 66. However, should the pressure on line 50 be released by breakage or otherwise, spring 24 urges piston 22 downwardly and urges the valve 18 outwardly into the flow path 68 as shown by the arrow in FIG. 3, and the fluid forces the valve into its "flat" position and against seat 54. This closes the valve and prevents upward flow of fluid in tubing 10. If pressure is reapplied through line 50, piston 22 is forced up and the valve is opened. Pressuring "up" tubing 10 can aid this.

When it is desired to pull the tool, all that is necessary to do is to go in with a pulling tool and connect on to running neck 16.

Although the above description has been given in considerable detail, various modifications can be made without departing from the spirit or scope of the invention.

We claim:

1. A downhole safety valve for use in a tubing string having a side pocket and a seat in said tubing string adjacent said pocket for use with a kickover tool which comprises:

an operator including a body member attachable to said kickover tool and settable in said pocket, a valve supported by said body and operable by said operator to open or close against said seat in said tubing string.

2. A downhole safety valve for use in a tubing string having a side pocket and for use with a kickover tool which comprises:

an operator attachable to said kickover tool, said operator having a drive arm, a pivot attached to said operator and at the inside wall of said pocket when oriented, a flapper valve pivotally attached to said pivot and attached to said drive arm of said operator such that said drive arm can rotate the valve about said pivot.

3. An apparatus as defined in claim 2 including means restricting the rotation of said valve about said pivot.

4. An apparatus as defined in claim 3 in which said means restricting the rotation includes a sleeve suspended at the lower end of said operator and extending outwardly over said valve and frangible means holding said sleeve in its extended position.

* * * * *